US009928729B2

(12) United States Patent
Komatsu et al.

(10) Patent No.: US 9,928,729 B2
(45) Date of Patent: Mar. 27, 2018

(54) INDOOR DEVICE, HOME SYSTEM, CONTROL METHOD, AND PROGRAM

(71) Applicant: Mitsubishi Electric Corporation, Tokyo (JP)

(72) Inventors: Masayuki Komatsu, Tokyo (JP); Satoshi Minezawa, Tokyo (JP); Masaaki Yabe, Tokyo (JP); Satoshi Endo, Tokyo (JP); Ichiro Maruyama, Tokyo (JP); Hiroaki Ushirosako, Tokyo (JP); Hirotoshi Yano, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 14/908,574

(22) PCT Filed: Aug. 5, 2014

(86) PCT No.: PCT/JP2014/070539
§ 371 (c)(1),
(2) Date: Jan. 29, 2016

(87) PCT Pub. No.: WO2015/020022
PCT Pub. Date: Feb. 12, 2015

(65) Prior Publication Data

US 2016/0171878 A1 Jun. 16, 2016

(30) Foreign Application Priority Data

Aug. 7, 2013 (JP) ..... 2013-164235

(51) Int. Cl.
*G08C 17/02* (2006.01)

(52) U.S. Cl.
CPC ..... *G08C 17/02* (2013.01); *G08C 2201/20* (2013.01); *G08C 2201/42* (2013.01); *G08C 2201/51* (2013.01); *G08C 2201/93* (2013.01)

(58) Field of Classification Search
CPC ..... G08C 2201/51; G08C 2201/20; G08C 2201/42; G08C 2201/93; G07C 17/02
See application file for complete search history.

(56) References Cited

U.S. PATENT DOCUMENTS 6,581,092 B1 * 6/2003 Motoyama ..... G06F 11/2294 709/206
7,155,213 B1 * 12/2006 Almeda ..... H04M 1/72533 340/12.53

(Continued)

FOREIGN PATENT DOCUMENTS

JP H04-170895 A 6/1992
JP 2000-074370 A 3/2000

(Continued)

OTHER PUBLICATIONS

International Search Report of the International Searching Authority dated Nov. 11, 2014 for the corresponding International application No. PCT/JP2014/070539 (and English translation).

(Continued)

*Primary Examiner* — Thomas Alunkal
(74) *Attorney, Agent, or Firm* — Posz Law Group, PLC

(57) ABSTRACT

A remote operation receiver (111) is configured to communicate with a communication terminal and receive a remote operation from outside a home. A remote operation monitor (112) is configured to monitor a state of communication with the communication terminal at the remote operation receiver (111) during an operation based on the remote operation. A notifier (114) is configured to provide in the home guidance to urge a user to conduct a manual operation on a manual operation receiver (121) when the remote operation monitor (112) detects that the communication with the communication terminal is discontinued. Then, an indoor device (10) is configured to make a shift to normal operation upon reception of the manual operation within a reference time period.

(Continued)

An abnormal remote operation processor (124) is configured to set an extended time period corresponding to an operation state and then make a transition of the indoor device (10) to a safe operation when no manual operation is received even if the reference time period has elapsed.

10 Claims, 9 Drawing Sheets

(56) References Cited

U.S. PATENT DOCUMENTS

| | | | | |
|---|---|---|---|---|
| 7,257,398 | B1 * | 8/2007 | Ukita | H04M 1/6066 348/14.05 |
| 2005/0035854 | A1 * | 2/2005 | Gupta | A61B 5/0062 340/531 |
| 2005/0047414 | A1 | 3/2005 | Terashima et al. | |
| 2005/0141566 | A1 * | 6/2005 | Krzyzanowski | H04L 12/2805 370/503 |
| 2005/0165918 | A1 * | 7/2005 | Wantanabe | H04N 5/782 709/223 |
| 2006/0200551 | A1 * | 9/2006 | Bali | H04L 43/0811 709/224 |
| 2007/0279248 | A1 * | 12/2007 | Matsumoto | G08C 23/04 340/13.24 |
| 2008/0062977 | A1 * | 3/2008 | Kaneko | H04L 12/2898 370/389 |

FOREIGN PATENT DOCUMENTS

| | | | |
|---|---|---|---|
| JP | 2003-150462 | A | 5/2003 |
| JP | 2004-304466 | A | 10/2004 |
| JP | 2005-184487 | A | 7/2005 |
| JP | 2006-163669 | A | 6/2006 |
| KR | 10-2006-0107739 | A | 10/2006 |

OTHER PUBLICATIONS

Extended European Search Report dated Feb. 10, 2017 issued in corresponding EP patent application No. 14835090.3.

Office Action dated Dec. 21, 2016 issued in corresponding KR patent application No. 10-2016-7004038 (and partial English translation).

Office Action dated Jun. 26, 2017 issued in corresponding KR patent application No. 10-2016-7004038 (and partial English translation).

* cited by examiner

INDOOR DEVICE, HOME SYSTEM, CONTROL METHOD, AND PROGRAM

CROSS REFERENCE TO RELATED APPLICATION

This application is a U.S. national stage application of International Application No. PCT/JP2014/070539 filed on Aug. 5, 2014, which claims priority to Japanese Patent Application No. 2013-164235 filed on Aug. 7, 2013, the contents of which are incorporated herein by reference.

TECHNICAL FIELD

The present disclosure relates to a technique for controlling an indoor device properly while ensuring safety even if the remote operation is disabled.

BACKGROUND ART

In recent years, home systems, in which various kinds of home electrical appliances and/or house equipment items (collectively, indoor device) installed in a home are connected in compliance with a prescribed communication standard (as an example, an energy management system or the like), have been extensively in use in general households. In such home systems, for example, various kinds of indoor devices such as air conditioners, lighting apparatuses, a rice cooker, an induction heating (IH) cooker, dehumidifiers, ventilation fans, and a water heater are communicably connected and the indoor devices can be properly managed (monitored and/or controlled).

Recently, a user can remotely operate indoor devices by accessing such a home system from outside of the home, such as a place the user is visiting, by using a communication terminal, such as a smartphone. However, in reality, a deteriorated communication environment around the communication terminal and/or a low battery voltage of the communication terminal may cause communication to be discontinued, whereby the remote operation is disabled. In such an occasion, the indoor device generally continues an operation based on the last command in the remote operation. Considering that no additional command is given, continuation of such an operation leads to a possible safety issue of concern.

As a prior art technique for the above home system, for example, Patent Literature 1 discloses a home automation (HA) remote operation system enabling detection of abnormal events.

CITATION LIST

Patent Literature

Patent Literature 1: Unexamined Japanese Patent Application Kokai Publication No. 2006-163669.

SUMMARY OF INVENTION

Technical Problem

However, the above-described Patent Literature 1 simply discloses a technique for detecting a failure at a management center or the like in the event that the HA end terminal system is subjected to a failure (disconnected line and/or short circuit), and discloses nothing about the control of an indoor device (an HA stove in the Patent Literature 1) the remote operation of which is disabled. Moreover, when the remote operation is disabled, for example, the indoor device can be stopped unconditionally. However, this unconditional stopping may impair the effect of remote operation and reduce the convenience aspect significantly.

The present disclosure is made for solving the above problem and an objective of the disclosure is to provide an indoor device, home system, control method, and program making proper control possible while ensuring safety even when the remote operation is disabled.

Solution to Problem

In order to achieve the above objective, the indoor device according to the present disclosure is an indoor device installed in a home and configured to operate a predetermined main function, including:

- a remote operation receiver configured to communicate with a communication terminal and receive a remote operation from outside the home;
- an operation receiver configured to receive an operation from inside the home;
- a main function controller configured to control an operation of the main function based on the remote operation received by the remote operation receiver or the operation received by the operation receiver;
- a communication monitor configured to monitor a state of communication with the communication terminal at the remote operation receiver during execution of an operation based on the remote operation; and
- a notifier configured to provide guidance in the home to urge a user to conduct an operation on the operation receiver when the communication monitor detects that the communication with the communication terminal is discontinued.

Advantageous Effects of Invention

A technique of the present disclosure makes proper control possible while ensuring safety even when the remote operation is disabled.

DESCRIPTION OF EMBODIMENTS

Figure 1:
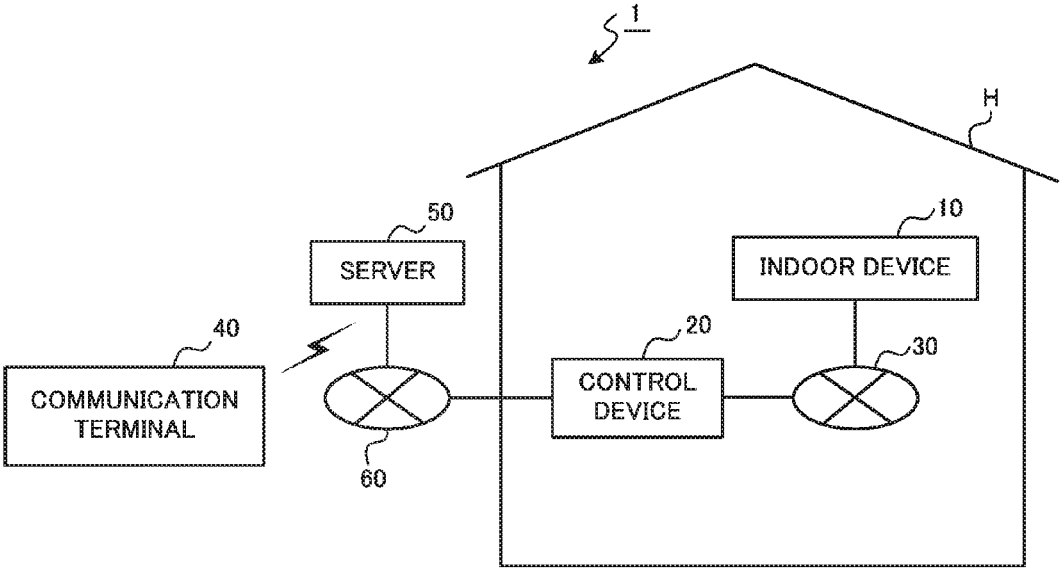
FIG. 1 is a schematic illustration showing an exemplary overall configuration of a home system according to Embodiment 1 of the present disclosure.

Embodiments of the present disclosure will be described in detail below with reference to the drawings, in which the same or corresponding components are designated by the same reference numerals.

Embodiment 1

FIG. 1 is a schematic illustration showing an exemplary overall configuration of a home system 1 according to Embodiment 1 of the present disclosure. The home system 1 is a system making it possible for a use to remotely operate an indoor device 10 installed in a home H by operating a communication terminal 40 from a place the user is visiting or the like. As shown in the figure, the home system 1 includes the indoor device 10, a control device 20, the communication terminal 40, and a server 50. The indoor device 10 and the control device 20 are communicably connected via an indoor network 30. Moreover, the server 50 and the control device 20 are communicably connected via an outdoor network 60.

The indoor device 10 is a home electrical appliance or house equipment item installed in the home H and, for example, an air conditioner, lighting apparatus, rice cooker, IH cooker, dehumidifier, ventilation fan, water heater or the like. The water heater and the like can be installed outside the home in part; however, such devices are included in the indoor device 10 for the purpose of explanation. An exemplary configuration of the indoor device 10 will be described below with reference to the block diagram of FIG. 2.

Figure 2:
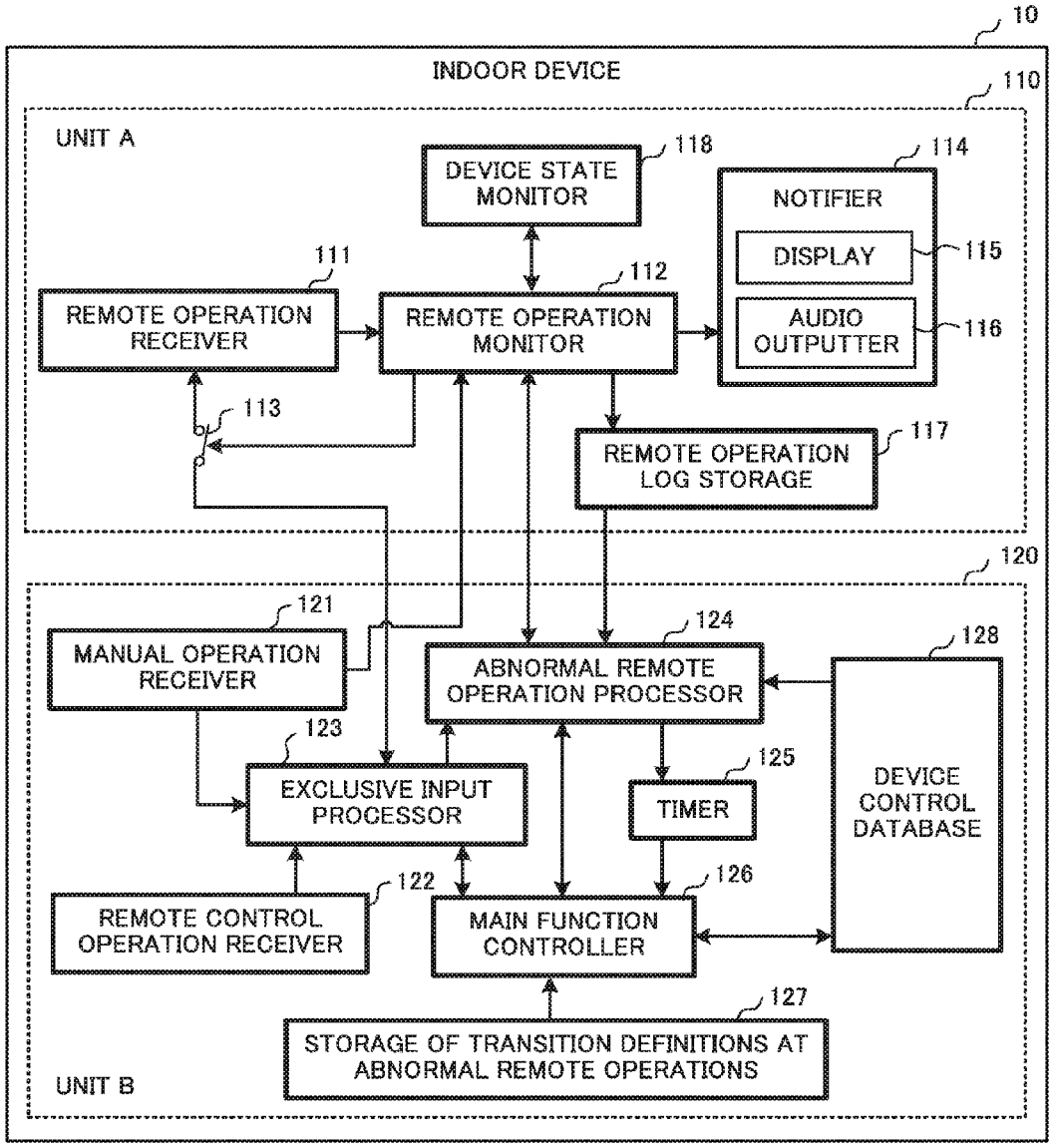
FIG. 2 is a block diagram showing an exemplary configuration of an indoor device according to Embodiment 1 of the present disclosure.

As shown in FIG. 2, the indoor device 10 includes a remote operation receiver 111, a remote operation monitor 112, a path 113, a notifier 114 (a display 115 and an audio outputter 116), a remote operation log storage 117, a device state monitor 118, a manual operation receiver 121, a remote control operation receiver 122, an exclusive input processor 123, an abnormal remote operation processor 124, a timer 125, a main function controller 126, a storage of transition definitions at abnormal remote operations 127, and a device control database 128. Here, the remote operation receiver 111 to the device state monitor 118 are configured as a unit A 110 and the manual operation receiver 121 to the device control database 128 are configured as a unit B 120. That is to say, the components of the unit A 110 and the components of the unit B 120 are independent from each other and, for example, even when a failure occurs in one unit, the other unit is not affected.

Moreover, the remote operation monitor 112, the device state monitor 118, the abnormal remote operation processor 124, and the main function controller 126 are implemented by, for example, a central processing unit (CPU), a read only memory (ROM), a random access memory (RAM), and the like (none of them are shown). In more detail, using the RAM as the work memory, the CPU executes various programs stored in the ROM as appropriate so as to implement each of the remote operation monitor 112, the device state monitor 118, the abnormal remote operation processor 124, and main function controller 126 as described below. Moreover, the remote operation monitor 112 and the device state monitor 118 of the unit A 110 and the abnormal remote operation processor 124 and the main function controller 126 of the unit B 120 may be implemented by different CPUs.

The remote operation receiver 111 includes, for example, a communication unit and the like, and communicates with the communication terminal 40 and receives remote operations and the like from outside the home H. For example, the remote operation receiver 111 receives a communication frame for remote operation (in more detail, a remote operation frat sent from the communication terminal 40 via the server 50 while a communication connection between the control device 20 and the server 50 is established. Additionally, the remote operation receiver 111 receives a communication frame for requesting the device state (in more detail, a state acquisition request frame) sent from the communication terminal 40. The state acquisition request frame is sent from the communication terminal 40 sequentially at fixed intervals during execution of the remote operation. Moreover, in response to the state acquisition request frame, the remote operation receiver 111 sends the current device state acquired by the main function controller 126 to the communication terminal 40 as described later. The remote operation receiver 111 supplies information of the received communication frame to the exclusive input processor 123 (when the path 113 is conductive (closed) as described later).

The remote operation monitor 112 monitors the state of communication with the communication terminal 40 at the remote operation receiver 111 during execution of the remote operation. For example, the remote operation monitor 112 monitors whether the remote operation receiver 111 has received from the communication terminal 40 the above-described state acquisition request frame, namely a communication frame to be sent from the communication terminal 40 at fixed intervals, within a predetermined reference time period so as to monitor the state of communication with the communication terminal 40. As an example, when the remote operation receiver 111 has received a state acquisition request frame within a fixed time period, the remote operation monitor 112 determines that the communication with the communication terminal 40 is maintained (the remote operation is enabled). However, when the remote operation receiver 111 has yet to receive a state acquisition request frame well beyond a fixed time period (for example, after the time period for two transmissions has elapsed), the remote operation monitor 112 determines that the communication with the communication terminal 40 is discontinued (the remote operation is disabled). When determining that the remote operation is disabled, the remote operation monitor 112 controls the notifier 114 to notify the user (a resident if any) in the home H accordingly (details will be described later). Moreover, in doing so, the remote operation monitor 112 requests the device state monitor 118 to monitor the device state and cuts off (opens) the path 113 described below.

The path 113 includes, for example, a control switch and the like, and opens and closes (cuts off and makes conductive) the transmission path connecting the remote operation receiver 111 to the exclusive input processor 123. The path 113 is controlled by the remote operation monitor 112 and, for example, made conductive only during execution of the remote operation. Moreover, even while the remote operation is in progress, the path 113 is controlled to cut off the transmission path when the remote operation is disabled (the communication is detected to be discontinued) as described above.

The notifier 114 provides the user (a resident) in the home H with notice that the remote operation is disabled and/or with guidance to urge the user to conduct an operation on the manual operation receiver 121 when the remote operation is disabled (the communication with the communication terminal 40 is detected to be discontinued) while the remote operation is in progress. More specifically, the notifier 114 includes a display 115 and an audio outputter 116 and gives the following guidance with display and/or audio. The display 115 includes, for example, a liquid crystal display and the like, and displays character messages stating that the remote operation is disabled and/or urging an operation on the manual operation receiver 121. Moreover, the display 115 may be an indicator configured to cause the LED defining notification contents to emit light. Moreover, the audio outputter 116 includes, for example, an audio guide unit and the like, and outputs audio messages stating that the remote operation is disabled and/or urging an operation on the manual operation receiver 121. Moreover, the audio outputter 116 may be a buzzer or the like, which outputs an alarm sound defining notification contents.

The remote operation log storage 117 accumulates and stores a log of the remote operations received by the remote operation receiver 111.

The device state monitor 118 monitors the device state of the indoor device 10 when the remote operation is disabled. For example, as the remote operation monitor 112 detects that the communication with the communication terminal 40 is discontinued while the remote operation is in progress, the device state monitor 118 starts monitoring the device state. More specifically, the device state monitor 118 collects the device state, which is otherwise to be collected from the communication terminal 40, in place of the communication terminal 40 and monitors whether an abnormal event has occurred on the device. As an example, when the collected device state includes information of temperature and/or voltage, the device state monitor 118 determines that an abnormal event has occurred on the device when the collected temperature exceeds a predetermined upper limit temperature (or lower limit temperature) and/or the collected voltage exceeds a predetermined upper limit voltage (or lower limit voltage). When an abnormal event on the device is determined as just described, the device state monitor 118 notifies an abnormal remote operation processor 124 described later of the abnormal device event.

The manual operation receiver 121 includes be, for example, a switch panel and the like, and receives manual operations from the user (a resident) in the home H. The manual operation receiver 121 supplies information presenting the contents of the received operation (signals or the like) to the exclusive input processor 123 and/or the above-described remote operation monitor 112.

The remote control operation receiver 122 includes, for example, an infrared reception unit and the like, and similarly receives remote control operations from the user in the home H. That is to say, the remote control operation receiver 122 receives infrared signals or the like sent when the remote control of the indoor device 10 is operated and receives a remote control operation Obtained by decoding or the like. The remote control operation receiver 122 supplies information presenting the contents of the received operation (signals or the like) to the exclusive input processor 123.

The exclusive input processor 123 exclusively processes one operation from among remote operation, manual operation, and remote control operation. For example, the exclusive input processor 123 selects one operation from among remote operation, manual operation, and remote control operation with a single operation through a procedure to check for conflicts due to simultaneous inputs of remote operation, manual operation, and remote control operation or a procedure according to the priority, and supplies the contents of the operation to the main function controller 126 and/or the abnormal remote operation processor 124.

The abnormal remote operation processor 124 controls the main function controller 126 in place of the communication terminal 40 and eventually makes a transition to a predetermined safe operation of the device when the communication is discontinued and the remote operation is disabled during the execution of the remote operation. The safe operation, which is determined depending on the indoor device 10 (the device type or the like) and is suitable in terms of safety, is defined and stored in a storage of transition definitions at abnormal remote operations 127 described later. Moreover, multiple safe operations may be defined depending on the device. More specifically, when the indoor device 10 is an air conditioner, air blowing and stop operations are defined as the safe operations. As another example, when the indoor device 10 is a water heater, a stop operation is defined as the safe operation. Moreover, when the indoor device 10 is a ventilation fan, a low power consumption operation is defined as the safe operation. Additionally, when the indoor device 10 is a rice cooker, a keep warm operation (stop operation at an abnormal device event) is defined as the safe operation. The above safe operations are given as examples and can be changed as appropriate depending on the actual indoor device 10.

When the remote operation is disabled, the abnormal remote operation processor 124 sets an extended time period to make a transition to the above safe operation depending on the operation state of the device, and controls the main function controller 126 to make a transition to the safe operation after the extended time period has elapsed. For example, when the indoor device 10 is a water heater, which is heating water and finishes heating water within a predetermined time period, the abnormal remote operation processor 124 sets the remaining time required to finish heating water as the extended time period. Then, after this extended time period has elapsed, the abnormal remote operation processor 124 controls the main function controller 126 to make a transition to a safe operation (stop in this case). As an example, the abnormal remote operation processor 124 may set a stop timer (a timer 125 described later) for the extended time period and activate the timer. Additionally, for example, when the indoor device 10 is a rice cooker, which has started cooking rice, the abnormal remote operation processor 124 sets the remaining time required to finish cooking the rice as the extended time period. Then, after this extended time period has elapsed, the abnormal remote operation processor 124 controls the main function controller 126 to make a transition to a safe operation (keep warm in this case). The above method of setting an extended time period is given as an example and can be changed as appropriate depending on the type and/or more detailed operation state of the indoor device 10.

The timer 125 may be a time measuring unit or the like and measures the above-described extended time period and the like. Moreover, the timer 125 is also used for timer operations (for example, as an activation timer and/or a stop timer).

The main function controller 126 controls the operation of the main function of the indoor device 10 (for example, the function of air conditioning in the case of an air conditioner, heating water in the case of a water heater, cooking rice in the case of a rice cooker, and the like). For example, the main function controller 126 controls an operation ordered through remote operation or manual operation based on a sequence stored in a device control database 128 described later and the like. Moreover, the main function controller 126 successively acquires the current device state and manages the current device state as state information in the device control database 128.

Figure 3:
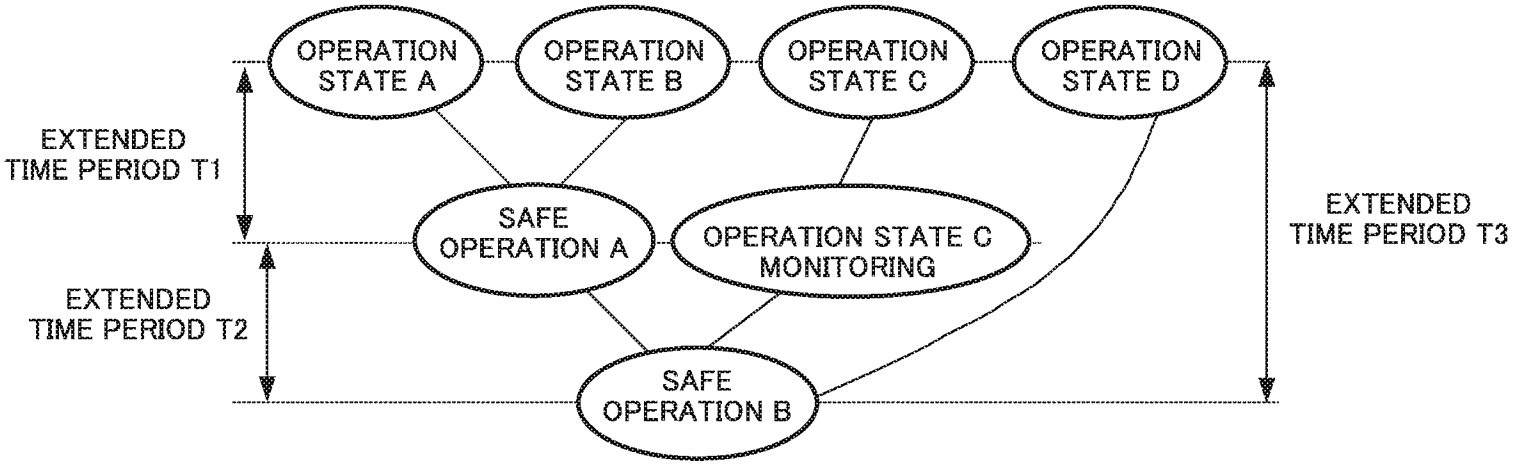
FIG. 3 is a schematic chart showing exemplary transition definitions stored in the storage of transition definitions at abnormal remote operations of the indoor device.

The storage of transition definitions at abnormal remote operations 127 stores definition information regarding operations to make a transition to, including the above-described safe operations, at times of abnormal remote operation (namely when the remote operation is disabled). As an example, the storage of transition definitions at abnormal remote operations 127 stores transition definitions as shown in FIG. 3. Here, FIG. 3 is a schematic chart presenting transitions in an easily understandable manner. Actual transition definitions are defined using code values and/or numerical values. In FIG. 3, safe operations to make a transition to and the like are defined in accordance with operation states A to D of the indoor device 10 (the main function) at times of abnormal remote operation. In this figure, multiple safe operations (safe operations A, B, and the like) are defined. More specifically, FIG. 3 defines, for example, the following. When the indoor device 10 is in an operation state A or in an operation state B at a time of abnormal remote operation, the indoor device 10 should make a transition to the safe operation A after an extended time period T1 has elapsed and subsequently make a transition to the safe operation B after an extended time period T2 has elapsed. Moreover, when the indoor device 10 is in an operation state C at a time of abnormal remote operation, the indoor device 10 should make a transition to the operation state C monitoring after an extended time period T1 has elapsed and subsequently make a transition to the safe operation B after an extended time period T2 has elapsed. Additionally, the following is also defined. When the indoor device 10 is in an operation state D at a time of abnormal remote operation, the indoor device 10 should make a transition to the safe operation B after an extended time period T3 has elapsed. Here, the above extended time periods T1 to T3 are not fixed values and are set by the abnormal remote operation processor 124 according to the actual operation states or the like as described above.

Returning to FIG. 2, in the device control database 128, for example, various kinds of sequences for controlling the operation of the main function and the like are stored. Moreover, the current device state and the like is successively updated by the main function controller 126 and is stored in the device control database 128.

Returning to FIG. 1, the control device 20 is installed in the home H, and communicates with and manages the indoor device 10 via the indoor network 30. Moreover, the control device 20 also has the home gateway (HGW) function and relays communication between the outdoor network 60 and the indoor device 10. For example, the control device 20 sends communication frames sent from the communication terminal 40 (the above-described remote operation frame, state acquisition request frame, and the like) to the indoor device 10 with a communication connection to the server 50 established. The control device 20 also sends information sent from the indoor device 10 (device state and other data) to the communication terminal 40. An exemplary configuration of the control device 20 will be described below with reference to the block diagram of FIG. 4.

Figure 4:
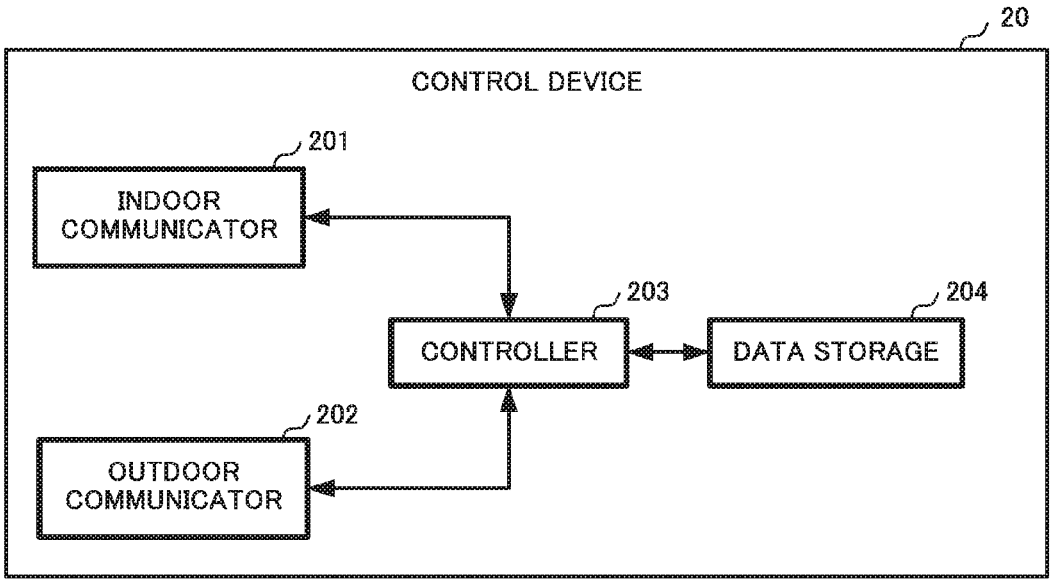
FIG. 4 is a block diagram showing an exemplary configuration of a control device according to Embodiment 1 of the present disclosure.

As shown FIG. 4, the control device 20 includes an indoor communicator 201, an outdoor communicator 202, a controller 203, and a data storage 204.

The indoor communicator 201 includes, for example, a wired local area network (LAN), wireless LAN communication unit, and the like and is controlled by the controller 203 and communicates with the indoor device 10 via the indoor network 30. As an example, the indoor communicator 201 receives information sent from the indoor device 10 (device state and other data).

The outdoor communicator 202 comprises, for example, a communication unit, and is controlled by the controller 203 and communicates with the communication terminal 40 via the outdoor network 60. As an example, the outdoor communicator 202 receives communication frames sent from the communication terminal 40 (the above-described remote operation frame, state acquisition request frame, and the like).

The controller 203 comprises, for example, a CPU, ROM, RAM, and the like (none of them is shown), and controls the entire control device 20. As an example, as the outdoor communicator 202 receives a communication frame (the above-described remote operation frame, state acquisition request frame, or the like) sent from the communication terminal 40, the controller 203 controls the indoor communicator 201 to send the communication frame to the indoor device 10. Moreover, as the indoor communicator 201 receives device state or other data sent from the indoor device 10, the controller 203 controls the outdoor communicator 202 to send the data to the communication terminal 40.

The data storage 204 serves as a so-called secondary storage (auxiliary storage) and is configured by, for example, a readable/writable nonvolatile semiconductor memory such as a flash memory. The data storage 204 stores various kinds of information for managing the indoor device 10.

Returning to FIG. 1, the communication terminal 40 is, for example, a portable communication terminal such as a smartphone and is used by the user outside the home H such as a place he is visiting. The communication terminal 40 includes a communication interface connectable to the outdoor network 60 and the like, and communicates with the indoor device 10 via the server 50 and the like. For example, the communication terminal 40 accesses the server 50 on the outdoor network 60, conducts a predetermined authentication process, and then establishes a communication connection between the server 50 and the control device 20. In this state, the communication terminal 40 communicates with the indoor device 10 through the server 50 and the control device 20. That is to say, the communication terminal 40 enables remote operation of the indoor device 10 from outside the home H as described above.

The server 50 is a server communicable with the communication terminal 40 and the control device 20 via the outdoor network 60. The server 50 stores, for example, various kinds of information for identifying a subscriber user (as examples, a registered user name, a registered password, identification information of the communication terminal 40, identification information of the control device 20, and the like). Then, after conducting a predetermined authentication process with the communication terminal 40, the server 50 establishes a communication connection to the control device 20 based on set connection information and the like. In this state, the server 50 sends information sent from the communication terminal 40 (the remote operation frame, state request frame, and the like) to the indoor device 10 via the control device 20, and also sends information sent from the indoor device 10 (device state and other data) to the communication terminal 40.

Figure 5:
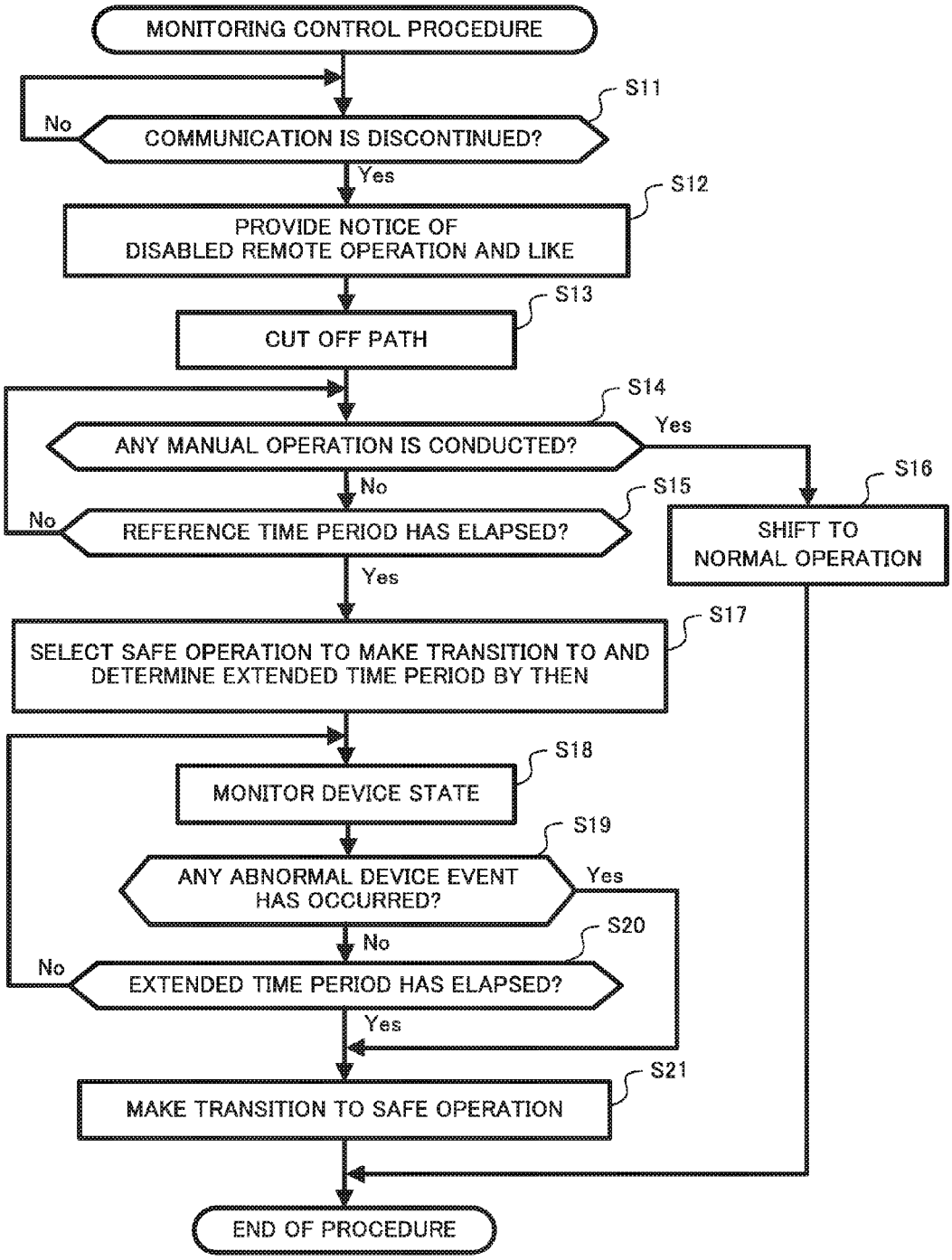
FIG. 5 is a flowchart showing an exemplary monitoring control procedure according to Embodiment 1 of the present disclosure.

Operation of the indoor device 10 in the home system 1 having the above configuration will be described below. In more detail, operation of the indoor device 10 during execution of the remote operation will be described with reference to FIG. 5. FIG. 5 is a flowchart showing an example of the monitoring control procedure of the indoor device 10 according to Embodiment 1 of the present disclosure. This monitoring control procedure is executed while the indoor device 10 is remotely operated with the communication terminal 40 in order to monitor the remote operation.

First, the indoor device 10 determines whether the communication with the communication terminal 40 is discontinued (Step S11). In other words, the remote operation monitor 112 monitors the state of communication with the communication terminal 40 at the remote operation receiver 11 and determines whether the communication is discontinued. More specifically, the remote operation monitor 112 determines that the communication with the communication terminal 40 is discontinued when the remote operation receiver 111 has received no state acquisition request frame supposed to be sent from the communication terminal 40 at fixed time intervals well beyond the fixed time period (for example, the time period for two transmissions has elapsed). If the communication with the communication terminal 40 is determined as being not discontinued (Step S11; No), the indoor device 10 redetermines whether the communication is discontinued. That is to say, the indoor device 10 continues to monitor the state of communication with the communication terminal 40 as long as the remote operation is in progress.

In contrast, when the communication with the communication terminal 40 is determined as being discontinued (step S11; Yes), the indoor device 10 provides notice of the disabled remote operation and the like (Step S12). In other words, as the remote operation monitor 112 detects that the communication is discontinued, the notifier 114 provides the user (a resident if any) in the home H with notice that the remote operation is disabled and/or with guidance to urge the user to conduct an operation on the manual operation receiver 121. For example, the notifier 114 provides messages stating that the remote operation is disabled and/or urging operation on the manual operation receiver 121 with display on the display 115 and audio output from the audio outputter 116 (or either one).

The indoor device 10 cuts off the path 113 (Step S13). In other words, the remote operation monitor 112 cuts off the path 113 of the transmission path connecting the remote operation receiver 111 to the exclusive input processor 123.

The indoor device 10 determines whether a manual operation is conducted (Step S14). In other words, the remote operation monitor 112 determines whether the user (a resident) in the home H has conducted an operation from the manual operation receiver 121 in response to the notification from the notifier 114. If no manual operation is conducted (Step S14; No), the indoor device 10 determines whether a reference time period has elapsed (Step S15). Then, when the reference time period has not elapsed (Step S15; No), the indoor device 10 returns the processing to the above-described Step S14. That is to say, the indoor device 10 waits for any manual operation from the user a resident) in the home H until the reference time period has elapsed.

When a manual operation is determined as being conducted in the above-described Step S14 (Step S14; Yes), the indoor device 10 makes a shift from remote operation to normal operation (manual operation by a resident) (Step S16). In other words, the main function controller 126 controls the operation of the main function in accordance with manual operations from the manual operation receiver 121. That is to say, even when the remote operation is disabled, the indoor device 10 continues to be operated by the user (a resident) in the home H. As the shift to normal operation is made, the indoor device 10 ends the monitoring control procedure.

In contrast, when the reference time period has elapsed in the above-described Step S15 without any manual operation conducted (Step S15; Yes), the indoor device 10 selects a safe operation to make a transition to and determines an extended time period to start the transition (Step S17). In other words, the abnormal remote operation processor 124 selects a safe operation to make a transition to by making reference to the storage of transition definitions at abnormal remote operations 127 and sets an extended time period to make a transition to the safe operation depending on the device operation state and the like. For example, when the indoor device 10 is a water heater, a stop operation is defined as the safe operation to make a transition to as described above. The abnormal remote operation processor 124 selects the safe operation (stop) and determines an extended time period depending on the operation state of the water heater. As an example, when the water heater is heating water and finishes heating water within a predetermined time period, the abnormal remote operation processor 124 sets the remaining time required to finish heating water as the extended time period. Additionally, for example, when the indoor device 10 is a rice cooker, a keep warm operation (stop operation at an abnormal device event defined as the safe operation to make a transition to as described above. The abnormal remote operation processor 124 selects the safe operation and determines an extended time period depending on the operation state of the rice cooker. As an example, when the rice cooker has started cooking rice, the abnormal remote operation processor 124 selects a keep warm operation as the safe operation and sets the remaining time required to finish cooking the rice as the extended time period.

The indoor device 10 monitors the device state (Step S18). In other words, the device state 118 collects the device state, which is otherwise to be collected by the communication terminal 40 if the remote operation is continued, in place of the communication terminal 40, and monitors whether an abnormal event has occurred on the device.

The indoor device 10 determines whether an abnormal device event has occurred (Step S19). In other words, the device state monitor 118 determines whether an abnormal event has occurred on the device from the device state collected in place of the communication terminal 40. As an example, assuming that the collected device state includes information of temperature and/or voltage, the device state monitor 118 determines that an abnormal event has occurred on the device when the collected temperature exceeds a predetermined upper limit temperature and/or the collected voltage exceeds a predetermined upper limit voltage.

When no occurrence of abnormal device event is determined (Step S19: No), the indoor device 10 determines whether the extended time period has elapsed (Step S20). Then, when the extended time period has not elapsed (Step S20: No), the indoor device 10 returns the processing to the above-described Step S18. That is to say, the indoor device 10 determines whether an abnormal event has occurred while monitoring the device state by itself until the extended time period has elapsed.

When the occurrence of an abnormal device event is determined in the above-described Step S19 (Step S19; Yes), the indoor device 10 advances the processing to Step S21 described below without waiting for the extended time period to elapse. In contrast, when the extended time period has elapsed in the above-described Step S20 without any abnormal device event having occurred (Step S20; Yes), the indoor device 10 makes a transition to a safe operation (Step S21). In other words, the abnormal remote operation processor 124 controls the main function controller 126 to make a transition to a safe operation. For example, when the indoor device 10 is a water heater and a stop operation is selected as the safe operation to make a transition to in the above-described Step S17, the abnormal remote operation processor 124 controls the main function controller 126 to make a transition of the operation of the main function to the stop operation. Additionally, for example, when the indoor device 10 is a rice cooker and a keep warm operation is selected as the safe operation to make a transition to in the above-described Step S17, the abnormal remote operation processor 124 controls the main function controller 126 to make a transition of the operation of the main function to the keep warm operation. Moreover, when the occurrence of an abnormal device event is determined in the above-described Step S19, the abnormal remote operation processor 124 controls the main function controller 126 to make a transition of the operation of the main function to the stop operation.

After making a transition to a safe operation, the indoor device 10 ends the monitoring control procedure. Moreover, multiple safe operations may be defined as described above. In such a case, the indoor device 10 repeatedly returns the processing to the above-described Step S17 to select a safe operation to make a subsequent transition to and determine an extended time period, and executes Steps S18 to S21 repeatedly. Then, when there is no more safe operation to make a subsequent transition to, the indoor device 10 ends the monitoring control procedure.

In the event that the remote operation is disabled when the resident is in the home H, the monitoring control procedure as described above allows the indoor device 10 to be continuously operated by notifying the resident of the event. Moreover, even when no resident is present, a transition to a safe operation is made after a necessary extended time period has elapsed, whereby the remote operation that has been made so far is not wasted and the convenience is maintained. Moreover, when the remote operation is disabled, the indoor device 10 monitors the device state by itself, whereby the safety management equivalent to that provided during the remote operation can be achieved. As a result, even when the remote operation is disabled, proper control is available while ensuring safety.

In Embodiment 1 set forth above, the indoor device (indoor device 10) includes a user interface (the manual operation receiver 121 and the notifier 114) and has the capability of notification by itself. However, the indoor device may not have such a user interface. In such a case, if the control device (control device 20) has a user interface, the indoor device may cooperate with the control device for notification. The home system according to Embodiment 2 of the present disclosure characterized in that the indoor device and the control device cooperate for notification will be described below.

Embodiment 2

Figure 6:
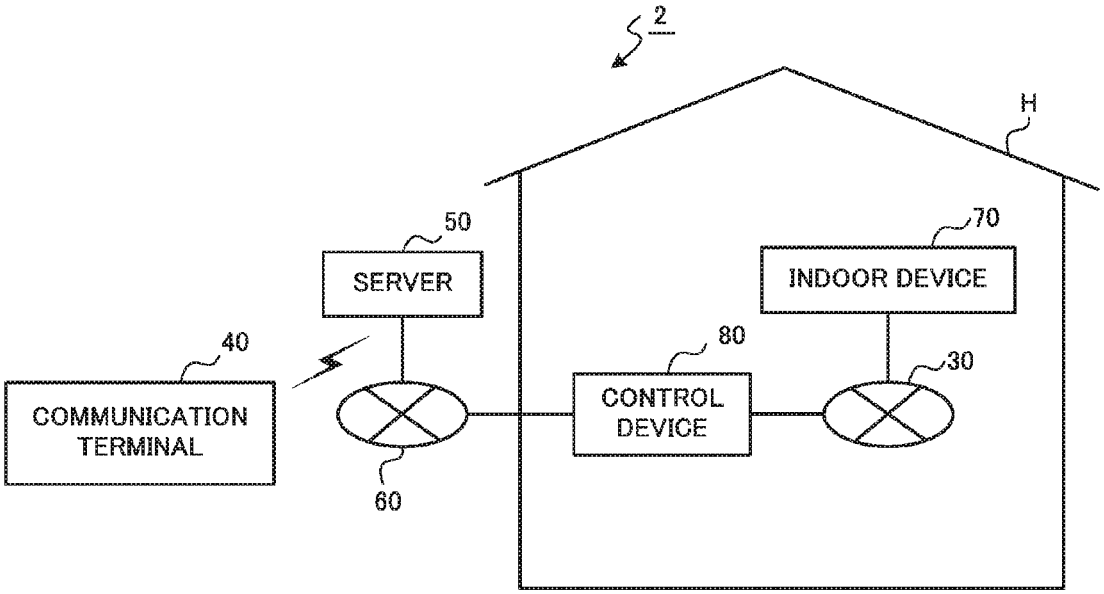
FIG. 6 is a schematic illustration showing an exemplary overall configuration of a home system according to Embodiment 2 of the present disclosure.

FIG. 6 is a schematic illustration showing an exemplary entire configuration of a home system 2 according to Embodiment 2 of the present disclosure. This home system 2 is also a system making it possible for a user to remotely operate an indoor device 70 installed in a home H by operating a communication terminal 40 from a place the user is visiting or the like. In FIG. 6, the same components as in the above-described home system 1 in FIG. 1 are referred to by the same reference numerals and the description thereof will be simplified as appropriate.

As shown in FIG. 6, the home system 2 includes the indoor device 70, a control device 80, the communication terminal 40, and a server 50. The indoor device 70 and the control device 80 are communicably connected via an indoor network 30. The server 50 and control device 80 are communicably connected via an outdoor network 60.

The indoor device 70 is, similar to the indoor device 10 according to Embodiment 1, a home electrical appliance or house equipment item installed in the home H and, for example, an air conditioner, lighting apparatus, rice cooker, IH cooker, dehumidifier, ventilation fan, water heater, or the like. An exemplary configuration of the indoor device 70 will be described below with reference to the block diagram of FIG. 7.

Figure 7:
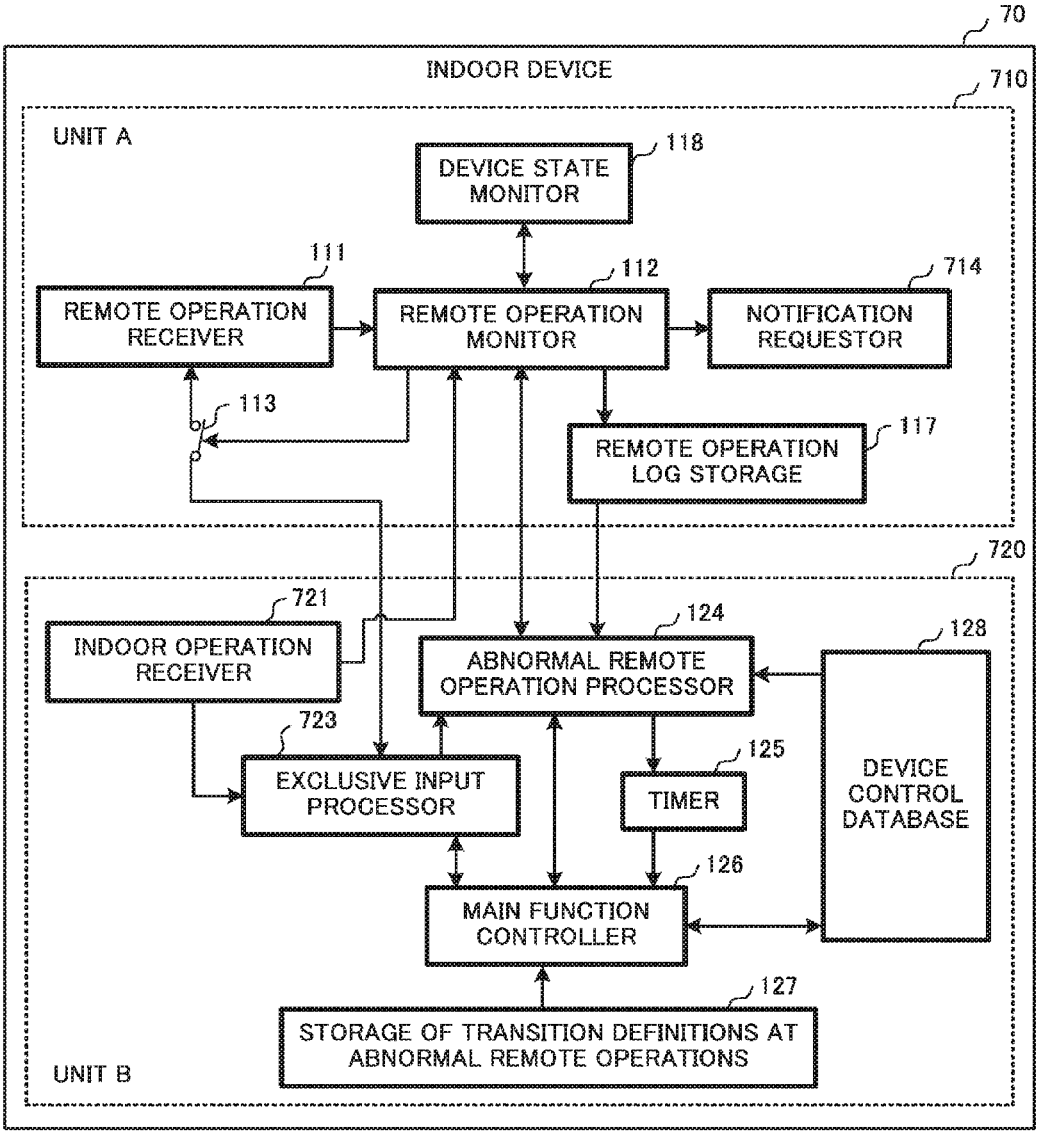
FIG. 7 is a block diagram showing an exemplary configuration of an indoor device according to Embodiment 2 of the present disclosure.

As shown in FIG. 7, the indoor device 70 includes a remote operation receiver 111, a remote operation monitor 112, a path 113, a notification requestor 714, a remote operation log storage 117, a device state monitor 118, an indoor operation receiver 721, an exclusive input processor 723, an abnormal remote operation processor 124, a timer 125, a main function controller 126, a storage of transition definitions at abnormal remote operations 127, and a device control database 128. In FIG. 7, the same components as of the above-described indoor device 10 in FIG. 2 are referred to by the same reference numerals and the description thereof will be simplified as appropriate.

In place of the notifier 114 (display 115 and audio outputter 116) included in the indoor device 10 in FIG. 2, the indoor device 70 additionally includes the notification requestor 714. Moreover, in place of the manual operation receiver 121 and the remote control operation receiver 122 included in the indoor device 10 in FIG. 2, the indoor device additionally includes the indoor operation receiver 721. Moreover, the exclusive input processor 123 is changed to the exclusive input processor 723. The other components of the indoor device 70, in other words the remote operation receiver 111, the remote operation monitor 112, the remote operation log storage 117, the device state monitor 118, the abnormal remote operation processor 124, the timer 125, the main function controller 126, the storage of transition definitions at abnormal remote operations 7, and the device control database 128 are the same as those of the indoor device 10 in FIG. 2. Moreover, the components of a unit A 710 and the components of a unit B 720 are similarly independent from each other and, for example, even when a failure occurs in one unit, the other unit is not affected.

The notification requestor 714 is controlled by the remote operation monitor 112, and requests the control device 80 to provide notice of the predetermined contents via the indoor network 30. In other words, the notification requestor 714 requests the control device 80 having a notifier 806 described later to provide notice of the disabled remote operation or the like when the remote operation is disabled (the communication with the communication terminal 40 is detected to be discontinued) during execution of the remote operation.

The indoor operation receiver 721 includes, for example, a communication unit and the like, and when the control device 80 is manually operated, receives from the control device 80 data presenting the contents of the operation (an indoor operation). That is to say, the indoor operation receiver 721 receives indoor operation data sent from the control device 80.

The exclusive input processor 723 exclusively processes one operation from remote operation and indoor operation. For example, the exclusive input processor 723 selects one operation from remote operation and indoor operation with a single operation through a procedure to check for conflicts due to simultaneous inputs of remote operation and indoor operation or a procedure according to the priority, and supplies the contents of the operation to the main function controller 126 and/or the abnormal remote operation processor 124.

Returning to FIG. 6, similar to the control device 20 according to Embodiment 1, the control device 80 is installed in the home H, and communicates with the indoor device 70 via the indoor network 30 to manage the indoor device 70. Moreover, the control device 80 has the HGW function and relays communication between the outdoor network 60 and the indoor device 70. An exemplary configuration of the control device 80 will be described below with reference to the block diagram of FIG. 8.

Figure 8:
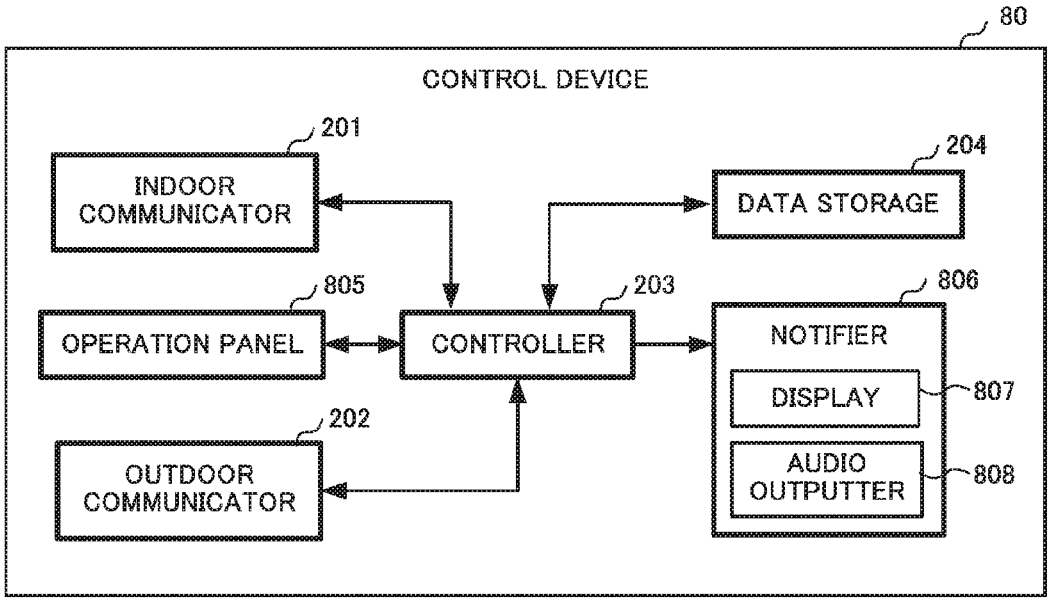
FIG. 8 is a block diagram showing an exemplary configuration of a control device according to Embodiment 2 of the present disclosure.

As shown in FIG. 8, the control device 80 includes an indoor communicator 201, an outdoor communicator 202, a controller 203, a data storage 204, an operation panel 805, and a notifier 806. In FIG. 8, the same components as of the above-described control device 20 in FIG. 4 are referred to by the same reference numerals and the description thereof will be simplified as appropriate.

The control device 80 further includes the operation panel 805 and the notifier 806 in addition to the configuration of the control device 20 in FIG. 4. Therefore, the indoor communicator 201 to the data storage 204 are the same components as of the control device 20 in FIG. 4.

The operation panel 805 includes, for example, a panel switch and the like, and is operated by the user (a resident if any) in the home H.

The notifier 806 includes a display 807 and an audio outputter 808, is controlled by the controller 203, and provides the following notice with display and audio (or either one). The display 807 includes, for example, a liquid crystal display and the like, and displays character messages stating that the remote operation of the indoor device 70 is disabled and/or urging an operation on the operation panel 805. Moreover, the display 807 may be an indicator configured to cause the LED defining notification contents to emit light. Moreover, the audio outputter 808 includes, for example, an audio guide unit or the like, and outputs audio messages stating that the remote operation of the indoor device 70 is disabled and/or urging an operation on the operation panel 805. Moreover, the audio outputter 808 may be a buzzer outputting an alarm sound defining notification contents.

As the indoor communicator 201 receives a notification request sent from the indoor device 70, the controller 203 controls the notifier 806 to provide the user a resident) in the home H with notice that the remote operation of the indoor device 70 is disabled and/or with guidance to urge an operation on the operation panel 805. Moreover, as an operation for the indoor device 70 is conducted on the operation panel 805, the controller 203 sends the contents of the operation from the indoor communicator 201 to the indoor device 70 as an indoor operation.

Returning to FIG. 6, the communication terminal 40 is, for example, a portable communication terminal such as a smartphone as in Embodiment 1, and used by the user outside the home H such as a place he is visiting. Moreover, the server 50 is a server communicable with the communication terminal 40 and/or control device 80 via the outdoor network 60 as in Embodiment 1.

Figure 9:
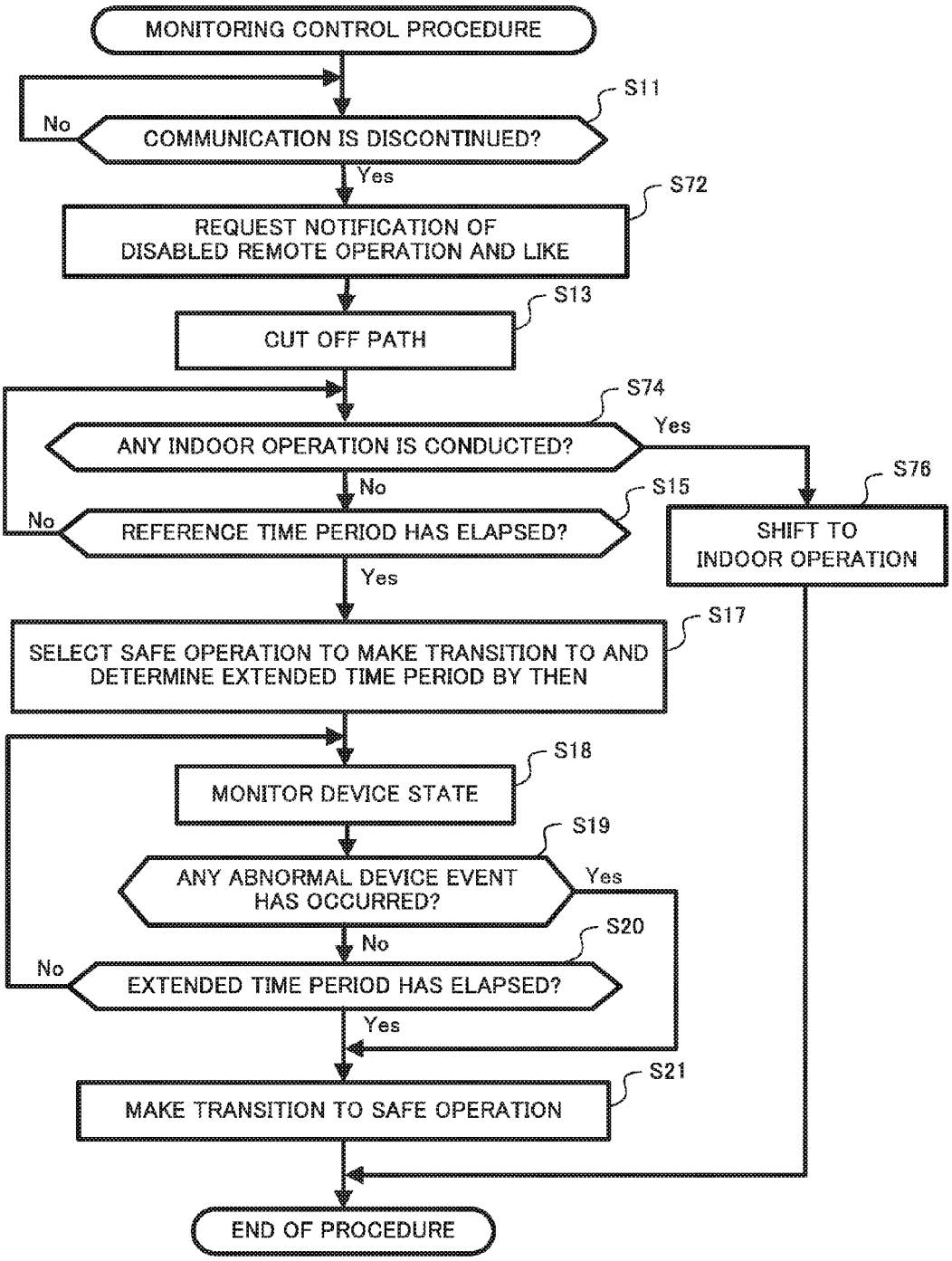
FIG. 9 is a flowchart showing an example of a monitoring control procedure according to Embodiment 2 of the present disclosure.

Operation of the indoor device 70 in the home system 2 as described above will be described below. In more detail, operation of the indoor device 70 during execution of the remote operation will be described with reference to FIG. 9. FIG. 9 is a flowchart showing an example of the monitoring control procedure of the indoor device 70 according to Embodiment 2 of the present disclosure. In FIG. 9, the same processing steps as of the above-described flowchart of FIG. 5 are referred to by the same reference numerals and the description thereof will be simplified as appropriate. This monitoring control procedure is also executed while the indoor device 70 is remotely operated with the communication terminal 40 in order to monitor the remote operation, as in Embodiment 1.

First, the indoor device 70 determines whether the communication with the communication terminal 40 is discontinued (Step S11). In other words, the remote operation monitor 112 monitors the state of communication with the communication terminal 40 at the remote operation receiver 111 and determines whether the communication is discontinued. If the communication with the communication terminal 40 is determined as being not discontinued (Step S11; No), the indoor device 70 redetermines whether the communication is discontinued. That is to say, the indoor device 70 continues to monitor the state of communication with the communication terminal 40 as long as the remote operation is in progress.

In contrast, when the communication with the communication terminal 40 is determined as being discontinued (Step S11; Yes), the indoor device 70 requests the control device 80 to provide notice of the disabled remote operation and the like (Step S72). In other words, as the remote operation monitor 112 detects that the communication is discontinued, the notification requestor 714 requests the control device 80 to provide notice of the remote operation being disabled and the like.

The indoor device 70 cuts off the path 113 (Step S13). In other words, the remote operation monitor 112 cuts off the path 113 of the transmission path connecting the remote operation receiver 111 and the exclusive input processor 123.

The indoor device 70 determines whether an indoor operation is received (Step S74). In other words, the remote operation monitor 112 determines whether the user (a resident) in the home H has conducted an operation on the operation panel 805 in response to the notification from the notifier 806 (the display 807 and the audio outputter 808) of the control device 80 and the indoor operation receiver 721 has received the contents of the operation. If no indoor operation is conducted (Step S74; No), the indoor device 70 determines whether a reference time period has elapsed (Step S15). Then, if the reference time period has not elapsed (Step S15; No), the indoor device 70 returns the processing to the above-described Step S74. That is to say, the indoor device 70 waits for an indoor operation from the user a resident) in the home H via the control device 80 until the reference time period has elapsed.

If an indoor operation is conducted in the above-described Step S74 (Step S74; Yes), the indoor device 70 makes a shift from remote operation to indoor operation (operation by a resident on the operation panel 805 of the control device 80) (Step S76). In other words, the main function controller 126 controls the operation of the main function according to the indoor operation received at the indoor operation receiver 721. That is to say, even when remote operation of the indoor device 70 is disabled, indoor operation by the us a resident) in the home H via the control device 80 will be conducted thereafter. As a shift to indoor operation is made, the indoor device 70 ends the monitoring control procedure.

In contrast, when the reference time period has elapsed in the above-described Step S15 without any indoor operation conducted (Step S15; Yes), the indoor device 70 selects a safe operation to make a transition to and determines an extended time period to start the transition (Step S17).

The indoor device 70 monitors the device state (Step S18). In other words, the device state monitor 118 collects the device state, which is otherwise to be collected by the communication terminal 40 if the remote operation is continued, in place of the communication terminal 40, and monitors whether an abnormal event has occurred on the device.

The indoor device 70 determines whether an abnormal device event has occurred (Step S19). In other words, the device state monitor 118 determines whether an abnormal event has occurred on the device from the device state collected in place of the communication terminal 40.

When no occurrence of abnormal device event is determined (Step S19; No), the indoor device 70 determines whether the extended time period has elapsed (Step S20). Then, when the extended time period has not elapsed (Step S20; No), the indoor device 70 returns the processing to the above-described Step S18. That is to say, the indoor device 70 determines whether an abnormal event has occurred while monitoring the device state by itself until the extended time period has elapsed.

When the occurrence of an abnormal device event is determined in the above-described Step S19 (Step S19: Yes), the indoor device 70 advances the processing to Step S21 without waiting for the extended time period to elapse. In contrast, when the extended time period has elapsed in the above-described Step S20 without any abnormal device event having occurred (Step S20: Yes), the indoor device 70 makes a transition to the safe operation (Step S21). In other words, the abnormal remote operation processor 124 controls the main function controller 126 to make a transition to the safe operation.

After making a transition to the safe operation, the indoor device 70 ends the monitoring control procedure. Moreover, multiple safe operations may be defined, as described above. In such a case, the indoor device 70 repeatedly returns the processing to the above-described Step S17 to select a safe operation to make a subsequent transition to and to determine an extended time period, and executes Step S18 to S20 repeatedly. Then, if there is no more safe operation to make a subsequent transition to, the indoor device 70 ends the monitoring control procedure.

In the event that the remote operation is disabled when the resident is in the home H, the monitoring control procedure as described above allows the indoor device 10 to be continuously operated via the control device 80 by notifying the resident of the event. Moreover, even when no resident is present, a transition to a safe operation is made after a necessary extended time period has elapsed, whereby the remote operation that has been made so far is not wasted and the convenience is maintained. Moreover, when the remote operation is disabled, the indoor device 70 monitors the device state by itself. Whereby the safety management equivalent to that provided during the remote operation can be achieved. As a result, even when the remote operation is disabled, proper control is available while ensuring safety.

Other Embodiments

Embodiments 1 and 2 set forth above describes, for the purpose of easier understanding of the present disclosure, the control device 20 or 80 which does not collect information of the indoor device 10 or 70. However, in practice, the control device 20 or 80 may collect from the indoor device 10 or 70 and manage the device information and the like. More specifically, while the indoor device 10 or 70 is remotely operated from the communication terminal 40, a state acquisition request frame is sent also from the control device 20 or 80 to the indoor device 10 or 70 at fixed time intervals. In such a case, the remote operation monitor 112 clearly distinguishes from which the state acquisition request frame received by the remote operation receiver 111 is sent, the communication terminal 40 or the control device 20 or 80, and monitors the state of communication with the communication terminal 40. For example, the remote operation monitor 112 checks the transmission source address in the state acquisition request frame and determines from which the state acquisition request frame is sent, the communication terminal 40 or the control device 20 or 80. Then, as in the embodiments set forth above, when the remote operation receiver 111 has received no state acquisition request frame sent from the communication terminal 40 well beyond the fixed time interval (for example, after the time period for two transmissions has elapsed), the remote operation monitor 112 determines that the communication with the communication terminal 40 is discontinued (the remote operation is disabled).

Additionally, the control device 20 or 80 may stop sending a state acquisition request frame from itself when no state acquisition request frame to be relayed is received from the communication terminal 40. For example, triggered by receiving a state acquisition request frame sent from the communication terminal 40 and sending the state acquisition request frame to the indoor device 10 or 70, the control device 20 or 80 sends a state acquisition request frame from itself to the indoor device 10 or 70. Therefore, if not receiving a state acquisition request frame from the communication terminal 40, the control device 20 or 80 does not send a state acquisition request frame from itself. In such a case, the indoor device 10 or 70 (the remote operation monitor 112) does not identify the transmission source of a state acquisition request frame, and determines that the communication with the communication terminal 40 is discontinued (the remote operation is disabled) when no state acquisition request frame is received within a reference time period, as in the above-described Embodiments 1 and 2.

In Embodiments 1 and 2 set forth above, the communication terminal 40 establishes a communication connection to the control device 20 or 80 via the server 50. However, it is possible to allow the communication terminal 40 to directly establish a communication connection to the control device 20 or 80 without using the server 50.

In Embodiments 1 and 2 set forth above, a dedicated indoor device 10 or 70 is used. However, it is possible to cause an existing personal computer, information terminal device, or the like to function as the indoor device 10 or 70 according to the present disclosure by applying the operation program defining the operation of the indoor device 10 or 70 to the personal computer or the like.

Moreover, the above program can be distributed by any method, and may be stored and distributed on a non-transitory computer-readable recording medium such as a compact disk read only memory (CD-ROM), digital versatile disk (DVD), magneto-optical disk (MO), and memory card, or distributed via a communication network such as the Internet.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

The present disclosure is based on Japanese Patent Application No. 2013-164235, filed on Aug. 7, 2013, of which the specification, scope of claims, and drawings are entirely incorporated herein by reference.

INDUSTRIAL APPLICABILITY

The present disclosure is preferably used in indoor devices, home systems, control methods, and programs that are capable of proper control while ensuring safety even when the remote operation is disabled.

REFERENCE SIGNS LIST

1,2 Home system
10, 70 Indoor device
20, 80 Control device
30 Indoor network
40 Communication terminal
50 Server
60 Outdoor network
111 Remote operation receiver
112 Remote operation monitor
113 Path
114, 806 Notifier
115, 807 Display
116, 808 Audio outputter
117 Remote operation log storage
118 Device state monitor
121 Manual operation receiver
122 Remote control operation receiver
123, 723 Exclusive input processor
124 Abnormal remote operation processor
125 Timer
126 Main function controller
127 Storage of transition definitions at abnormal remote operations
128 Device control database
714 Notification requestor
721 Indoor operation receiver
201 Indoor communicator
202 Outdoor communicator
203 Controller
204 Data storage
805 Operation panel

The invention claimed is:

1. An indoor device installed in a home and configured to operate a predetermined main function, the indoor device comprising:

a remote operation receiver configured to communicate with a communication terminal and to receive a remote operation from outside the home;

an operation receiver configured to receive an operation from inside the home;

a main function controller configured to control an operation of the main function based on the remote operation received by the remote operation receiver or the operation received by the operation receiver;

a communication monitor configured to monitor a state of communication between the communication terminal and the indoor device during execution of an operation based on the remote operation; and a notifier configured to provide notice that the remote operation is disabled or guidance to urge a user to conduct an operation on the operation receiver when the communication monitor detects that the communication with between the communication terminal and the indoor device is discontinued.

2. The indoor device according to claim 1, wherein the main function controller is configured to terminate the remote operation when the operation receiver receives an operation within a reference time period after the notifier provides the notice or the guidance, and to control the operation of the main function based on the operation received by the operation receiver.

3. The indoor device according to claim 1, further comprising:

an abnormal event processor configured to control the main function controller to make a transition to a predetermined safe operation when the operation receiver receives no operation after elapse of a reference time period after the notifier provides the notice or the guidance.

4. The indoor device according to claim 1, wherein the communication monitor is configured to cut off a transmission path connecting the remote operation receiver to the main function controller when the communication between the communication terminal and the indoor device is detected to be discontinued.

5. The indoor device according to claim 1, wherein a unit including at least the remote operation receiver and communication monitor is separate from a unit including at least the operation receiver and the main function controller.

6. The indoor device according to claim 3, wherein the abnormal event processor is configured to set an extended time period to make a transition to the safe operation based on an operation state of the main function, and the main function controller is configured to make a transition to the safe operation after elapse of the extended time period.

7. The indoor device according to claim 6, further comprising:

a device monitor configured to collect a device state collectable from the communication terminal in place of the communication terminal, wherein the abnormal event processor is configured to control the main function controller to immediately make a transition to the safe operation without waiting for the elapse of the extended time period when occurrence of an abnormal device event is determined from the device state collected by the device monitor.

8. A home system including an indoor device installed in a home and configured to operate a predetermined main function, a control device configured to manage the indoor device in the home, and a communication terminal configured to be used outside the home, wherein the indoor device comprises:

a remote operation receiver configured to receive a remote operation from the communication terminal;

an indoor operation receiver configured to receive an operation from inside the home via the control device;

a main function controller configured to control an operation of the main function based on the remote operation received by the remote operation receiver or an indoor operation received by the indoor operation receiver;

a communication monitor configured to monitor a state of communication with the communication terminal at the remote operation receiver during execution of an operation based on the remote operation; and a notification requestor configured to request the control device to provide notice that the remote operation is disabled or guidance to urge an indoor operation when the communication monitor detects that the communication with the communication terminal is discontinued, and the control device comprises:

an outdoor communicator configured to relay communication between the communication terminal and the indoor device;

an operator configured to be operated by a user in the home;

an indoor communicator configured to send the indoor operation corresponding to an operation on the operator to the indoor device and to receive a notification request sent from the indoor device; and a notifier configured to provide notice that the remote operation is disabled or guidance to urge a user to conduct an operation on the operator when the indoor communicator receives the notification request.

9. A control method for an indoor device installed in a home and configured to operate a predetermined main function, the control method comprising:

a remote operation reception step of communicating with a communication terminal and receiving a remote operation from outside the home;

an operation reception step of receiving an operation from inside the home;

a main function control step of controlling an operation of the main function based on the remote operation received in the remote operation reception step or the operation received in the operation reception step;

a communication monitoring step of monitoring a state of communication between the communication terminal and the indoor device during execution of an operation based on the remote operation; and a notification step of providing notice that the remote operation is disabled or guidance to urge a user to conduct the operation in the operation reception step when the communication between the communication terminal and the indoor device is detected to be discontinued in the communication monitoring step.

10. A non-transitory computer-readable recording medium storing a program, the program causing a computer installed in a home and configured to operate a predetermined main function to function as:

a remote operation receiver configured to communicate with a communication terminal and to receive a remote operation from outside the home;

an operation receiver configured to receive an operation from inside the home;

a main function controller configured to control an operation of the main function based on the remote operation received by the remote operation receiver or the operation received by the operation receiver;

a communication monitor configured to monitor a state of communication between the communication terminal and the indoor device during execution of an operation based on the remote operation; and a notifier configured to provide notice that the remote operation is disabled or guidance to urge a user to conduct an operation on the operation receiver when the communication monitor detects that the communication between the communication terminal and the indoor device is discontinued.

* * * * *